US005511714A

United States Patent [19]

Bauer et al.

[11] Patent Number: 5,511,714

[45] Date of Patent: Apr. 30, 1996

[54] SEALING DEVICE FOR THE DRIVER MEMBER OF A PNEUMATICALLY OPERATED DRIVING TOOL FOR FASTENERS

[75] Inventors: Joachim Bauer, Hamburg; Klaus Albrecht, Bad Oldesloe; Rolf Krahmer, Ahrensburg, all of Germany

[73] Assignee: Joh. Friedrich Behrens AG, Ahrensburg, Germany

[21] Appl. No.: 153,314

[22] Filed: Nov. 16, 1993

[30] Foreign Application Priority Data

Dec. 2, 1992 [DE] Germany ..... 9216394 U

[51] Int. Cl.[6] ..... B25C 5/13

[52] U.S. Cl. ..... 227/130; 227/120; 173/211

[58] Field of Search ..... 173/210, 211, 173/212; 227/130, 120, 156

[56] References Cited

U.S. PATENT DOCUMENTS

| | | | |
|---|---|---|---|
| 2,914,032 | 11/1959 | Powers et al. | 173/210 X |
| 3,086,207 | 4/1963 | Lingle et al. | 227/130 |
| 3,320,860 | 5/1967 | Bade | 227/130 X |
| 4,441,644 | 4/1984 | Farian | 173/210 X |
| 4,609,135 | 9/1986 | Elliesen | 173/210 X |
| 4,867,366 | 9/1989 | Kleinholz | 173/210 X |
| 4,932,480 | 6/1990 | Golsch | 173/210 |
| 5,020,712 | 6/1991 | Monacelli | 227/130 X |
| 5,025,971 | 6/1991 | Schafer et al. | 227/130 X |

FOREIGN PATENT DOCUMENTS

0326639B1 7/1988 European Pat. Off. .

*Primary Examiner*—Rinaldi I. Rada

*Attorney, Agent, or Firm*—Vidas, Arrett & Steinkraus

[57] ABSTRACT

The present invention relates to a sealing device for the driver member of a pneumatically operated driving tool for fasteners. It comprises a working cylinder, a working piston slidably arranged in said working cylinder for movement between an upper and a lower dead center, a resilient stop member defining the lower dead center of the working piston movement, a driving member secured to said working piston and extending through an opening of said stop member, a control valve actuated by a trigger to alternatively connect a cylinder space above said working piston with a source of compressed air and to atmosphere, and a piston return space in communication with a cylinder space below said working piston. The device further comprises a mouth tool including a driving channel for guiding said driver member, a magazine opening into said driving channel, and a vent passage extending from the inner face of said stop member along said driving channel towards the forward end of said driver member, to vent the cylinder space below said working piston to atmosphere until the downwardly moving driver member closes off said passage. According to the invention the stop member comprises a recess facing said mouth tool, said recess sealingly receiving an extension portion of said mouth piece in a resiliently biased engagement between said recess and said extension portion. The sealing device provides for improvements with respect to the sealing as well as to venting function.

13 Claims, 2 Drawing Sheets

SEALING DEVICE FOR THE DRIVER MEMBER OF A PNEUMATICALLY OPERATED DRIVING TOOL FOR FASTENERS

BACKGROUND OF THE INVENTION

The present invention relates to a sealing device for the driver member of a pneumatically operated driving tool for fasteners.

EP-B 0326 639 discloses a driving tool of this type. For performing a working stroke for driving a fastener into a workpiece, the working cylinder above the working piston is supplied with compressed air. The working piston moving downwardly displaces the air from the cylinder space below the piston through openings into an adjacent piston return chamber. When the working piston reaches its lower dead center which is defined by a stop member, the working space above the working piston is connected to atmosphere and the air accumulated in the piston return chamber drives the working piston back into its upper dead center. A control valve connects the upper cylinder chamber to a source of compressed air, or, respectively, to atmosphere. The control valve allows for performance of a single stroke operation for a repetitious operation.

To avoid a loss of air accumulated in the piston return chamber, the driver member must be provided in a sealing engagement with the cylinder. To accomplish this, the driver member may closely fit into a slot provided in the stop member. However, this has the drawback that a certain volume of air may be caught within the space below the working piston which is detrimental to a fast driving operation. Furthermore, the slot may be widened or otherwise damaged when the working piston hits the stop member which would adversely effect the sealing engagement. This might be remedied by providing a metallic disk to be the sealing element. The disk is supported between the stop member and a head piece at the bottom of the cylinder for guiding the drive member in a tight slot. Again, air below the working piston adversely effects a fast operation.

According to another structure of the prior art, the driver opening includes a vent passage or groove for venting the residual air. This vent groove extends from an opening in the stop member towards the forward end of the driver member located in the mouth tool. When the piston is located in its upper dead center, the residual air may be vented through the vent groove opening into the driver channel. In the downward stroke of the working piston, the driver member completely covers the groove after a short travel of the piston to seal the passage between the vent groove and atmosphere so that the accumulation of the return air is initiated.

It should be understood that problems are encountered in sealing the vent passage with respect to the working cylinder. It is known to squeeze an upper portion of the mouth tool into a metallic head piece supporting the resilient stop member. However, the squeezing operation is not easily performed when the plate-shaped sections of the mouth tool need to be accurately placed with respect to each other. Furthermore, the head piece may include a guiding and sealing means for the driver member, the mouth tool sealingly resting upon it. Although a squeezing operation is not required, the blade-shaped mouth tool portions must be accurately levelled to define a plane support surface for the driver member guiding means made of plastic material.

SUMMARY OF THE INVENTION

Accordingly, it is an object of the present invention to provide an improved sealing device which provides for an appropriate sealing operation, for venting the residual air and which can be fabricated with less expenditure.

According to the invention, the resilient stop member comprises a recess into which an extension portion of the mouth tool is sealingly received such that a resilient bias force acts between the extension portion and the stop member. The recess is located adjacent the opening in which the driver member is slidably arranged, while the extension portion of the mouth tool comprises a driver channel such that the driver member enters the driver channel when leaving the opening in the stop member. This results in a sealing engagement to prevent the air being compressed by the piston from flowing along the driver member to atmosphere. It should be understood that the vent passage is open towards the stop member to allow the residual air to vent through the free partial cross-section of the opening as long as the piston is located close to the upper dead center. As soon as the working stroke is initiated, the driver member completely covers the venting groove after traveling a relatively short distance, the vent passage is interrupted and the piston return chamber is practically completely sealed off. Accordingly, the invention provides for appropriate venting as well as sealing functions. The sealing device according to the invention can be easily fabricated and assembled by merely pressing the extension portion into the resilient recess of the stop member. The sealing function is primarily provided by shoulders on the extension portion. It is thus not necessarily required to accurately align the individual plates of the bipartite mouth tool with respect to the longitudinal axis thereof to provide an appropriate sealing effect. Connecting the mouth tool to the cylinder is thus facilitated. A particular advantage resides in the fact that the sealing effect is practically continuously maintained due to the resilient bias of the extension portion in the stop member recess.

According to a further feature of the invention, the cross-section of the recess may be rectangular to fit a mouth tool having blade-shaped sections. Shoulders provided in the recess of the stop member provide for accurate positioning of the mouth piece and improve the sealing engagement.

To improve the damping characteristics of the stop member, it may be formed in a cylindrical manner the end surface facing the working piston may include an opening of an enlarged diameter, and the outer edge maybe tapered towards the working piston. Thus cavities are provided into which material of the stop member may be displaced when the working piston is adjacent the stop member. This displacement of material does not substantially affect the sealing engagement of the mouth piece in the recess.

The foregoing and other objects, features and advantages of the present invention will become apparent in the light of the following detailed description of an exemplary embodiment thereof, as illustrated in the accompanying drawing:

DETAILED DESCRIPTION OF THE PREFERRED EMBODIMENT

Figure 1:
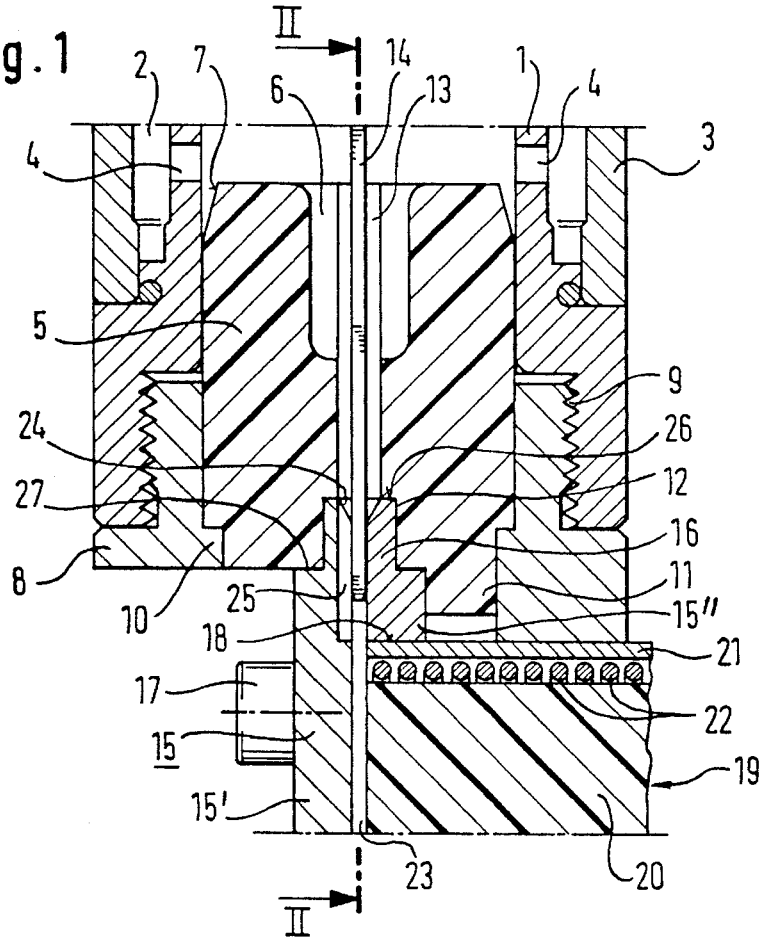
FIG. 1 is a sectional view of a sealing device according to the invention.
Figure 2:
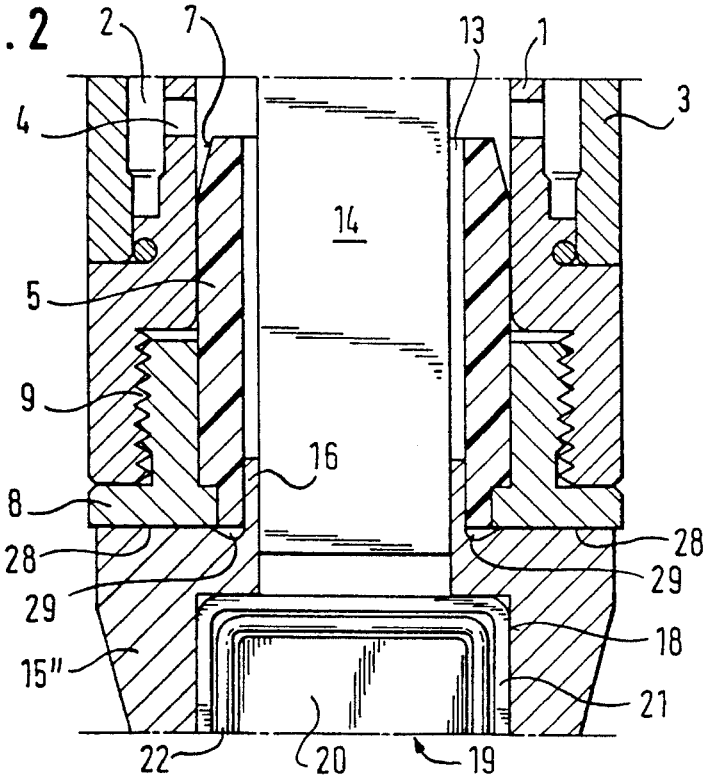
FIG. 2 is a sectional view taken along line II—II in FIG. 1.
Figure 3:
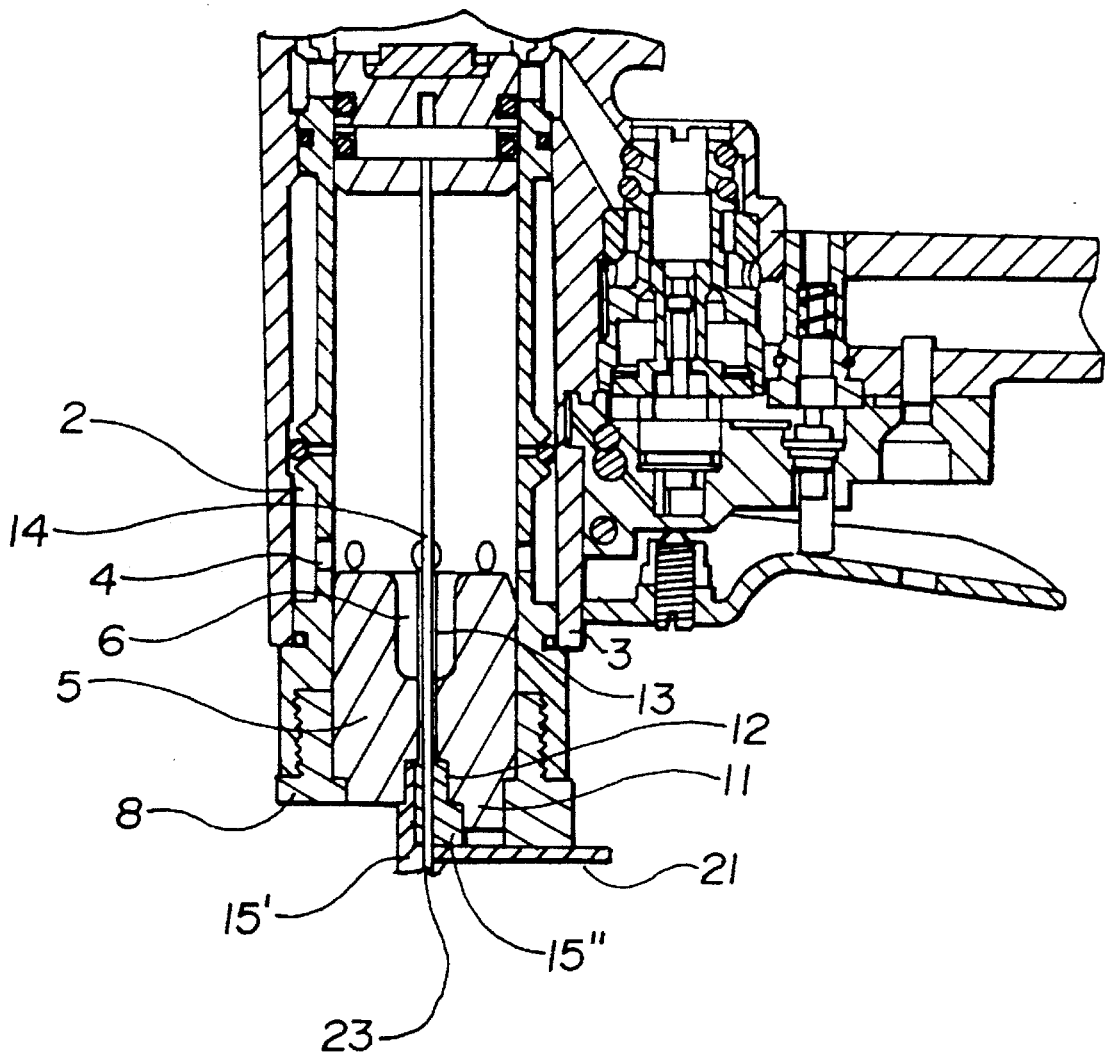
FIG. 3 is a sectional view of a control valve as it relates to the sealing device according to the invention.

As shown in FIGS. 1, 2 and 3, the sealing device is the sealing structure at the bottom of a working cylinder 1 of a pneumatically operated driving tool in which a working piston (not shown) is slidably received. The sealing device, or the sealing structure, is formed by the combination of a stop member oriented in the bottom of a working cylinder and a head piece and a mouth tool on which the stop member is positioned. The structure, orientation and relationship of these elements are further detailed below. A piston return chamber 2 surrounds the cylinder 1. A cylindrical casing 3 bears the reference numeral 3. Openings 4 connect the cylinder chamber to the piston return chamber 2 adjacent the upper end face of a resilient stop member 5, whereas upper openings spaced therefrom are not shown.

The stop member 5 is formed as a resilient body made of plastic material. The stop member includes an opening 6 of enlarged diameter extending about half way down. The upper edge of the bore facing the working piston (not shown) is tapered at 7. The bottom of the stop member 5 is supported by a head piece 8 mounted in the working cylinder 1, which comprises an inner threaded portion 9 for threadably receiving the head piece which includes a shoulder 10 at its inner edge engaging an inner shoulder 11 of the stop member.

The downwardly facing bottom portion of the stop member comprises a recess 12 which is in alignment with a slot 13 in the stop member 5 through which a blade-shaped driver member 14 extends which is secured to the working piston. The dimensions of the slot 13 are selected such that some play between the driver member 14 and the slot provides for venting of the working cylinder 1.

A mouth tool 15 comprising a pair of plate-shaped sections 15' and 15" each having an extension portion 16 which is received in the recess 12. Both the sections 15' and 15" are secured to each other by means of bolts 17. The mouth piece in turn is mounted to the head piece 8. The section 15" includes a side opening 18 for receiving a magazine 19, comprising a staple carrier 20, a staple cover 21 and fasteners 22 supported therebetween.

The opening 18 opens into a driving channel 23 which is formed between both tool sections 15' and 15". The driver channel receives the lower end of the driver member 14 which enters into the channel via a tapered portion 24 facing the upper slot 13. A venting groove 25 which opens into the tapered portion 24 is formed in the plate-shaped tool section 15' and extends along a portion of a driver channel 23. The venting groove 25 ends shortly below the end of the driver member 14, when the working piston is held in the upper dead center. The lower end of the venting groove 25 is substantially located at the height of the upper magazine opening 18.

The upper end face of the extension portion 16 rests upon an inner shoulder 26 of the recess 12. Spaced from the front face of the extension portion, there is an outer shoulder 27 resting upon the bottom surface of the stop member 5. Both tool sections 15' and 15" include outwardly projecting supporting surfaces 28 at either side, which rest upon the head piece 8 from below. Recesses 29 are formed between the supporting surfaces 28 and the extension portion 16 adjacent the stop member 5 and are required to be formed when the mouth tool sections are fabricated.

As to the operation of the driving tool referral is made to EP-B-0 326 639. In the position of the driver member 14 shown in FIG. 1, residual air can pass from the cylinder chamber below the piston through the bore 6 and the slot 13 and through the venting groove 25 and the driver channel 23 to atmosphere. After the working piston has moved a rather short distance of travel from its upper dead center, the blade-shaped driver member 14 which is guided along plane surfaces adjacent the venting groove 25, sealingly covers the venting groove preventing any further air to vent through the venting passage 25 into atmosphere. Accordingly any further air displaced by the downwardly moving working piston enters the piston return chamber 2 through the upper openings (not shown) and the lower openings 4. The main volume of the air passes through the upper openings which include an appropriate check valve. As soon as the control valve, as shown in FIG. 3, shifts to vent the cylinder chamber above the working piston to atmosphere, the compressed air from the piston return chamber returns the working piston towards its upper dead center. As soon as the driver member uncovers the vent passage 25 shortly before the return stroke is completed, the residual air may be vented through the venting passage to atmosphere.

What is claimed is:

1. A pneumatically operated driving tool, comprising a driver member, which has a forward end, a working cylinder, a working piston slidably arranged in said working cylinder for movement between an upper and a lower dead center, a resilient stop member having an opening and an inner face, the stop member defining the lower dead center of the working piston movement, the driving member being secured to said working piston and extending through the opening of said stop member, further comprising a control valve, a trigger and a first cylinder space above said working piston, wherein the control valve is actuated by the trigger to alternatively connect the first cylinder space with a source of compressed air and to atmosphere, a piston return space, which contains air, in communication with a second cylinder space below said working piston, into which the piston return space air is displaced while a working stroke of the working piston is performed, upon which the displaced piston return space air returns said working piston into the upper dead center when the first cylinder space is vented to atmosphere by means of said control valve, the driving tool still further comprising a plate-shaped mouth tool having an extension portion and a driving channel for guiding said driver member, a magazine opening into said driving channel, and a vent passage extending from the inner face of said stop member along said driving channel towards the forward end of said driver member, the vent passage venting the second cylinder space below said working piston to atmosphere until the downwardly moving driver member closes off said vent passage, said stop member comprising a recess facing said mouth tool, said recess sealingly receiving the extension portion of said mouth tool in a resiliently biased engagement between said recess and said extension portion.

2. The pneumatically operated driving tool of claim 1, wherein said recess in said stop member has a rectangular cross-section receiving said extension portion of the plate-shaped mouth tool.

3. The pneumatically operated driving tool of claim 1, the extension portion having a front end, wherein the front end of said extension portion rests on an internal shoulder formed in said recess.

4. The pneumatically operated driving tool of claim 1, wherein said extension portion rests on an external shoulder of said stop member.

5. The pneumatically operated driving tool of claim 1, wherein said driver member is blade-shaped extending through the opening, the opening being slot-shaped, in said stop member and which is in alignment with the driving channel of said mouth tool.

6. The pneumatically operated driving tool of claim 1, wherein said stop member is supported by a head piece mounted to the working cylinder, said head piece having an opening through which said stop member extends.

7. The pneumatically operated driving tool of claim 6, wherein said head piece includes an annular flange for supporting said stop member.

8. The pneumatically operated driving tool of claim 7, wherein said head piece includes an outer threaded portion for mounting in a threaded bore of the cylinder.

9. The pneumatically operated driving tool of claim 7, the mouth tool further comprising outwardly projecting support surfaces, wherein said mouth tool is mounted to said head piece by the outwardly projecting support surfaces.

10. The pneumatically operated driving tool of claim 9, wherein the support surfaces project outwardly on either side of said extension portion, said mouth tool has recesses between said support surfaces and said extension portion, and the recesses provide for a free space facing said stop member.

11. The pneumatically operated driving tool of claim 1, wherein said mouth tool has two sections, said driving channel being formed in one of said mouth tool sections.

12. The pneumatically operated driving tool of claim 1, wherein said stop member is substantially cylindrical including an enlarged bore facing said cylinder space below the working piston.

13. The pneumatically operated driving tool of claim 12, the stop member further comprising a tapered end facing the working pistons, wherein said stop member is tapered at the end facing said cylinder space.

* * * * *